US006060122A

United States Patent [19]

Rossmaier

[11] Patent Number: 6,060,122

[45] Date of Patent: May 9, 2000

[54] CORROSION PROTECTIVE CLEANING AGENT FOR TIN-PLATED STEEL

[75] Inventor: Henry Rossmaier, Duesseldorf, Germany

[73] Assignee: Henkel Kommanditgesellschaft aut Aktien, Dusseldorf, Germany

[21] Appl. No.: 08/913,930

[22] PCT Filed: Mar. 15, 1996

[86] PCT No.: PCT/EP96/01137

§ 371 Date: Sep. 24, 1997

§ 102(e) Date: Sep. 24, 1997

[87] PCT Pub. No.: WO96/30558

PCT Pub. Date: Oct. 3, 1996

[30] Foreign Application Priority Data

Mar. 24, 1995 [DE] Germany ..... 195 10 825

[51] Int. Cl.[7] ..... B05D 3/00

[52] U.S. Cl. ..... 427/327; 106/14.05; 106/14.13; 106/14.14; 106/14.21; 106/14.44; 427/409; 427/435; 427/443.2

[58] Field of Search ..... 427/435, 443.2, 427/409, 327; 106/14.05, 14.13, 14.14, 14.21, 14.44

[56] References Cited

U.S. PATENT DOCUMENTS

| | | | |
|---|---|---|---|
| 3,888,778 | 6/1975 | Beckwith et al. | 252/79.3 |
| 4,313,769 | 2/1982 | Frelin et al. | 148/6.27 |
| 4,370,177 | 1/1983 | Frelin et al. | 148/6.27 |
| 4,496,404 | 1/1985 | King | 148/6.14 R |
| 4,617,068 | 10/1986 | King | 148/6.14 R |
| 5,391,239 | 2/1995 | Boulos | 148/253 |

FOREIGN PATENT DOCUMENTS

| | | |
|---|---|---|
| 0 161 667 | 11/1985 | European Pat. Off. . |
| 24 12 134 | 10/1974 | Germany . |

OTHER PUBLICATIONS

Metal Finishing, 78(7):78 (Jul. 1980).

*Primary Examiner*—Bernard Pianalto
*Attorney, Agent, or Firm*—Ernest G. Szoke; Wayne C. Jaeschke; Norvell E. Wisdom, Jr.

[57] ABSTRACT

The invention concerns an aqueous corrosion-protective cleaning solution for tin-plated steel, in particular for tin-plated steel cans, the solution containing complex fluorides of the elements boron, titanium, zirconium, and hafnium; non-ionic surfactants; and corrosion inhibitors and having a pH within the range from 3 to 6. The invention also concerns an aqueous concentrate for preparing the solution by dilution with water and a method of cleaning tin-plated cans using the solution.

20 Claims, No Drawings

CORROSION PROTECTIVE CLEANING AGENT FOR TIN-PLATED STEEL

FIELD OF THE INVENTION

This invention relates generally to the cleaning and corrosion-proofing of tin-plated steel, more particularly food or beverage cans of this material, so-called "tin cans", between the forming and lacquering steps of the can manufacturing process.

TECHNICAL BACKGROUND AND RELATED ART

Tin cans are normally produced by preliminary forming, deep drawing and smoothing. They have a desirable bright surface so that, after coating with a clear or opaque organic lacquer or printing of the outer surface, they are suitable as an attractive pack. The sequence of process steps involved in the production of tin cans normally comprises offwinding the strip of tin plate provided with a layer of protective oil from the coil, applying drawing lubricants, preliminary forming into a cup and deep drawing and smoothing to the final shape. In the deep drawing and smoothing steps, cooling lubricants, such as water or aqueous emulsions, are normally also used to facilitate the deep drawing process. After forming, residues of the protective oil and deep drawing lubricants and also metal dust are removed in a cleaning steep. After the cleaning step, the containers pass through one or more water rinsing stages and are then dried in a drying oven. This is followed by lacquering in one or more stages and by decorative printing of the outer surface. Accordingly, the metal surface has to be of such quality that the lacquer has sufficient adhesion and affords reliable protection against corrosion.

In the production of such cans, however, it has been found that rust spots can develop during or before drying, particularly if the cans are cleaned with an acidic medium (pH 3–5), too much water is retained in certain areas or if, during stoppage of the production line, the individual process steps are not completed sufficiently quickly. Rust spots can thus develop. They are visible through the lacquer and promote poor lacquer adhesion, so that the product packed in such a container soon becomes unfit for consumption.

According to the teaching of EP-B-161 667, this problem can be solved in non-tinned steel cans, so-called black plate cans, by treating the cans after the actual cleaning step with an aqueous corrosion-inhibiting solution which contains 10 to 5,000 ppm of aluminum ions, 10 to 200 ppm of fluoride ions and up to 1,000 ppm of ions of at least one of the metals titanium, zirconium and/or hafnium and which has a pH value of 2 to 5.5.

The problem addressed by the present invention was to provide a treatment solution, a concentrate for its preparation and a treatment process with which tin cans could be cleaned and provided with a surface protected against corrosion in a single treatment step so that corrosion of the surface before lacquering would be prevented and firm lacquer adhesion would be promoted.

BRIEF SUMMARY OF THE INVENTION

In a first embodiment, the present invention relates to an aqueous treatment solution for tin-plated steel which contains:

100 to 400 ppm of complex fluorides of the elements boron, titanium, zirconium and/or hafnium;

100 to 2,000 ppm of nonionic surfactants;

100 to 1,000 ppm of corrosion inhibitor;

and, as the balance, water or an aqueous solution of other active ingredients or auxiliaries and which has a pH value in the range from 3 to 6.

DETAILED DESCRIPTION OF THE INVENTION

The following concentration ranges are particularly preferred for the individual active ingredients:

150 to 300 ppm of complex fluorides of the elements boron, titanium, zirconium and/or hafnium;

300 to 1,000 ppm of nonionic surfactants;

150 to 500 ppm of corrosion inhibitor.

The addition of aluminum ions to the cleaning solution in a concentration of about 50 to 300 ppm and, preferably, about 80 to about 200 ppm has been found to have positive effects.

An aluminum salt soluble in the concentration range mentioned is preferably used as the source of aluminum ions. For example, aluminum nitrate and, in particular, aluminum sulfate are suitable for this purpose, aluminum chloride being less preferred in the interests of corrosion control.

Depending on the surface condition of the cans before cleaning, the additional presence in the cleaning solution of one or more monobasic, dibasic or tribasic hydroxycarboxylic acids containing 4 to 7 carbon atoms in the molecule (the sum total of hydroxyl and carboxyl groups being at least 3) as a further active ingredient or auxiliary in a concentration of 200 to 800 ppm can have favorable effects. The hydroxycarboxylic acid(s) is/are preferably selected from monobasic or dibasic hydroxycarboxylic acids containing 6 carbon atoms and at least 4 hydroxyl groups. Gluconic acid is particularly preferred. It does not matter whether the acids are used as such or in the form of their salts soluble in the concentration range mentioned, more particularly in the form of their sodium salts. At the pH value of the cleaning solution in the range from 3 to 6, the acids will be present partly in their acid form and partly as carboxylate anions, depending on their acid constants.

The complex fluorides of the elements boron, titanium, zirconium and/or hafnium may also be used in the form of their acids, for example tetrafluoroboric acid or the hexafluoro acids of titanium, zirconium and hafnium, or in the form of salts soluble in the concentration range mentioned, for example the alkali metal salts. Since these complex fluorides represent anions of strong acids, they will largely be present in ionic form in the pH range from 3 to 6.

In a particularly preferred embodiment, the cleaning solution contains complex fluorides of boron in addition to complex fluorides of at least one of the metals titanium, zirconium and hafnium, particularly zirconium. A particularly preferred cleaning solution contains complex fluorides of boron and of zirconium in a ratio by weight of 4:1 to 1:1 and, more particularly, in a ratio by weight of 3:1 to 1.5:1.

Preferred nonionic surfactants are surfactants or surfactant mixtures which have a cloud point below about 40 to about 45° C. The cleaning solution may thus be applied by spraying at a working temperature of about 50 to about 70° C. without excessive and troublesome foaming occurring. Suitable surfactants are, in particular, ethoxylates and ethoxylates/propoxylates of alkanols containing about 10 to about 18 carbon atoms. The ethoxylates and/or the ethoxylates/propoxylates may also be end-capped and may be present, for example, as butyl ethers. The ethoxylates preferably contain 4 to 12 ethylene oxide groups and, more particularly, about 6 to 10 ethylene oxide groups while the ethoxylates/propoxylates preferably contain 3 to 7 ethylene oxide groups and 2 to 6 propylene oxide groups, preferably 4 to 6 ethylene oxide groups and 3 to 5 propylene oxide groups. The alkanol component may be a pure compound having a certain carbon chain length. However, it is economically more attractive to use alkanols of oleochemical origin (oxoalcohols) in which different alkanols with various carbon chain lengths are present. For example, the alkanol component may be a fatty alcohol mixture containing 12 to 14 carbon atoms or an oxoalcohol containing 12 to 15 carbon atoms. A particularly preferred surfactant mixture contains both alkanol ethoxylates and alkanol ethoxylates/propoxylates, for example in a ratio by weight of 1:3 to 1:1.

The corrosion inhibitor(s) may be selected, for example, from mono-, di- or triethanolamine, aromatic carboxylic acids, pyridine or pyrimidine derivatives and diethyl thiourea. Among the ethanolamines, triethanolamine is particularly preferred for toxicological reasons (avoidance of nitrosamine formation). Particularly suitable aromatic carboxylic acids are benzoic acid and substitution products thereof. Examples include methyl benzoic acids, nitrobenzoic acids, aminobenzoic acids, for example anthranilic acid or p-aminobenzoic acid, and hydroxybenzoic acids, for example salicylic acid. If the treated cans are to be used for foods, pyridine or pyrimidine derivatives and diethyl thiourea are less preferred. One example of a suitable inhibitor combination is a mixture of triethanolamine and benzoic acid, for example in a ratio by weight of 3:1 to 1:3. However, triethanolamine may also be used as sole corrosion inhibitor.

If the complex fluorides are used in the form of their acids in the preparation of the cleaning solution, it may be necessary to raise the pH value to the required range of about 3 to about 6 and, preferably, about 4 to about 5 by addition of a base. Basic alkali metal compounds, for example hydroxides or carbonates, are suitable for this purpose. However, ammonia is preferably used for adjusting the pH value.

In another embodiment, the present invention relates to the use of the cleaning solution characterized above for cleaning, corrosion-proofing and/or improving lacquer adhesion to articles of tin-plated steel, more particularly food or beverage cans. This process has the advantage over the conventional process that cleaning and temporary corrosion control can be achieved in a single treatment stage. The corrosion control prevents corrosion of the metal surfaces before lacquering, such as might occur, for example, in the event of plant stoppages. At the same time, lacquer adhesion and corrosion control after lacquering are both improved without any need for a further treatment stage after the cleaning stage. After the treatment with the cleaning solution, the cans are normally rinsed with water, dried at elevated temperature and then lacquered.

The present invention also relates to a process for cleaning, corrosion-proofing and/or improving lacquer adhesion to articles of tin-coated steel, more particularly food or beverage cans, in which the cans are treated with the cleaning solution described above for a period of about 30 to about 150 seconds at a temperature in the range from about 50 to about 70° C. The treatment may be carried out by spraying the cans with the cleaning solution or by dipping the cans in the cleaning solution. Spray cleaning is preferred.

The cleaning solution according to the invention may in principle be prepared by mixing the individual components together in situ in the concentration ranges mentioned above. In practice, however, such solutions are normally marketed in the form of aqueous concentrates which may be adjusted to the required concentration range by the user in situ by dilution with water. Accordingly, the present invention also relates to a water-based concentrate which, when mixed with water in a concentration of about 0.5 to about 2.5% by weight, forms the cleaning solution according to the invention. Besides water or an aqueous solution of other active ingredients or auxiliaries, this concentrate preferably contains 1 to 4% by weight of complex fluorides of the elements boron, titanium, zirconium and/or hafnium;

1 to 20% by weight of nonionic surfactants;

1 to 10% by weight of corrosion inhibitor.

The concentrate preferably contains as active ingredients:

1.5 to 3% by weight of complex fluorides of the elements boron, titanium, zirconium and/or hafnium;

0.5 to 3% by weight of aluminum ions; and 3 to 10% by weight of nonionic surfactants;

1.5 to 5% by weight of corrosion inhibitor.

An aluminum-containing concentrate preferably contains 2 to 8% by weight of one or more monobasic, dibasic or tribasic hydroxycarboxylic acids containing 4 to 7 carbon atoms in the molecule (the sum of hydroxyl and carboxyl groups being at least 3) as further active ingredients or auxiliaries.

The foregoing observations apply to the preferred choice of the individual components. To make the concentrate easier to prepare and to increase its stability in storage, one or more solubilizers are preferably present in addition to the actual active ingredients, preferably in a concentration range of about 1 to about 10% by weight and more preferably in a concentration range of about 3 to about 7% by weight. Suitable solubilizers are known substances, for example xylene sulfonates, alkyl phosphates (for example Triton® H66, a product of Union Carbide) and, in particular, cumene sulfonate. These anionic solubilizers are preferably used in the form of alkali metal salts, for example sodium and/or potassium salts.

EXAMPLES

Example 1

A cleaner concentrate according to the invention with the following composition was prepared by mixing the individual components in the following order:

| | |
|---|---|
| water | 70.8% by weight |
| fluoroboric acid | 1.1% by weight |
| potassium hexafluorozirconate | 0.7% by weight |
| aluminum sulfate · 17 $H_2O$ | 12.4% by weight |
| sodium gluconate | 3.3% by weight |
| $C_{12/14}$ fatty alcohol × 5 ethylene oxide × 4 propylene oxide | 3.7% by weight |
| $C_{12-15}$ oxoalcohol × 8 ethylene oxide | 1.2% by weight |
| Na cumene sulfonate (40% solution) | 4.3% by weight |
| triethanolamine | 2.5% by weight |

Aqueous cleaning solutions with a pH value of 4 to 4.5 were prepared from this concentrate in various concentrations and were used to clean tin cans soiled by residues of corrosion-inhibiting oils and deep-drawing lubricants by spraying for various periods at a temperature of 63° C. The cleaning effect was evaluated by visual assessment of the surface area free from water breaks (0: no cleaning, 100%: good cleaning). The results are set out in Table 1.

TABLE 1

CLEANING EFFECT OF THE CONCENTRATE OF EXAMPLE 1 MIXED IN VARIOUS CONCENTRATIONS

| Concentration (% by Weight) | Spraying Time (seconds) | % of Area Free from Water Breaks Outside/Inside |
|---|---|---|
| 0.7 | 45 | 60–65/ 100 |
| | 90 | 85–90/ 100 |
| | 60 | 75/ 100 |
| 0.9 | 45 | 75/ 85–90 |
| | 60 | 85–90/ 100 |
| | 90 | 100/ 100 |
| 1.2 | 45 | 90/ 100 |
| | 60 | 100/ 100 |

Example 2

To test the corrosion-inhibiting effect, concentrates according to Example 1 were prepared without the corrosion inhibitor, triethanolamine, or with complete or partial replacement thereof. Differences in the composition were made up with water. The concentrates were diluted with water to give a concentration of 1.2% by weight and the ready-to-use cleaning solution was sprayed onto tin cans for 60 seconds at a temperature of 63° C. The cans were then left standing in the spray compartment for 10 minutes without rinsing. The formation of thin-film rust was visually evaluated on a scale of scores: 6=very poor, 1=very good. The results are set out in Table 2.

TABLE 2

CORROSION-INHIBITING EFFECT

| Corrosion Inhibitor in the Concentrate (% by Weight) | Evaluation Score |
|---|---|
| None | 6 |
| 2.5 Triethanolamine | 3 |
| 0.83 Triethanolamine + 083 benzoic acid | 3.5 |
| 1.67 Triethanolamine + 1.67 benzoic acid | 2 |
| 1.67 Triethanolamine + 1.67 benzoic acid + 0.8 diethyl thiourea | 1.5 |
| 2.5 Benzoic acid | 3.5 |
| 1.5 Triethanolamine + 1.5 salicylic acid | 2 |

Example 3

To test the long-term corrosion-inhibiting effect after lacquering, tin cans were cleaned with various solutions, rinsed for 15 seconds with tap water and with deionized water, dried in a drying cabinet at 170° C. and lacquered once (two lacquer coatings are normally applied in practice). Two hundred eighty-eight (288) correspondingly treated cans were filled with Coca Cola® (Coke® and stored for 4 months. The number of rusted cans was then determined. The results are set out in Table 3.

TABLE 3

CORROSION TEST (288 CANS FILLED WITH COCA COLA ®)

| Cleaning*) | Perforated cans |
|---|---|
| Comp. 1 | 40 |
| Comp. 2 | 20 |
| Example 1 | 14 |

*) Comp. 1: tap water only.
Comp. 2: commercial alkaline spray cleaner based on NaOH, gluconate, nonionic surfactants, corrosion inhibitor. Used as directed.
Example 1 concentrate of Example 1, 1.2% by weight in water, temperature 63° C., pH 4.3, spraying for 60 seconds.

Example 4

A cleaning concentrate according to the invention with the following composition was prepared by mixing the individual components together in the following order:

| | |
|---|---|
| water | 68.1% by weight |
| fluoroboric acid (49% solution) | 1.1% by weight |
| potassium hexafluorozirconate | 0.7% by weight |
| aluminum sulfate · 18 $H_2O$ | 12.4% by weight |
| sodium gluconate | 3.3% by weight |
| $C_{12/14}$ fatty alcohol × 5 ethylene oxide × 4 propylene oxide | 3.7% by weight |
| $C_{12/14}$ fatty alcohol × 6 ethylene oxide | 1.2% by weight |
| Na cumene sulfonate (40% solution) | 5.3% by weight |
| triethanolamine | 4.2% by weight |

A 1.1% by weight aqueous solution with a pH value of 4.6 was prepared from this concentrate. Tin cans were cleaned with this solution by spraying for 1 minute at 60° C. and were then rinsed for 15 seconds with tap water and with deionized water, dried in a drying cabinet at 170° C. and lacquered twice. A lacquer adhesion test was then carried out both on the side and on the neck of the cans. To this end, the cans were placed in a boiling 1% detergent solution for 30 minutes, rinsed with water and dried. The lacquer was then cross-hatched and Scotch tape (No. 610) was applied and peeled off. Lacquer adhesion was generally complete apart from a few cases where it was substantially complete.

The invention claimed is:

1. A process for achieving at least one of cleaning, corrosion-proofing, and improving lacquer adhesion to tin-plated steel, said process comprising contacting the tin-plated steel with an aqueous solution having a pH value from 3 to 6 and containing water and:

100 to 400 ppm of complex fluorides selected from the group consisting of complex fluorides of boron, titanium, zirconium, hafnium, and mixtures of any two or more of boron, titanium, zirconium, and hafnium;

100 to 2,000 ppm of nonionic surfactants; and 100 to 1,000 ppm of corrosion inhibitor; and, optionally, one or more of the following components:

aluminum ions, hydroxycarboxylic acids and solubilizers.

2. A process as claimed in claim 1, wherein said aqueous solution contains:

150 to 300 ppm of complex fluorides of boron, titanium, zirconium, hafnium, and mixtures of any two or more of boron, titanium, zirconium, and hafnium;

50 to 300 ppm of aluminum ions;

300 to 1,000 ppm of nonionic surfactants; and 150 to 500 ppm of corrosion inhibitor.

3. A process as claimed in claim 2, wherein said aqueous solution also contains:

200 to 800 ppm of one or more monobasic, dibasic or tribasic hydroxycarboxylic acids having from 4 to 7 carbon atoms in each molecule and a sum of hydroxyl and carboxyl groups in each molecule that is at least 3.

4. A process as claimed in claim 3, wherein the hydroxycarboxylic acid molecules are selected from monobasic or dibasic hydroxycarboxylic acid molecules each containing 6 carbon atoms and at least 4 hydroxyl groups.

5. A process as claimed in claim 4, wherein said aqueous solution contains complex fluorides of both boron and zirconium in a ratio by weight of 4:1 to 1:1.

6. A process as claimed in claim 5, wherein the nonionic surfactants are selected from the group consisting of (i) alkanol ethoxylates having from 10 to 18 carbon atoms and 4 to 12 oxyethylene moieties in each molecule and (ii) alkanol ethoxylate/propoxyplates having from 10 to 18 carbon atoms, 3 to 7 oxyethylene moieties and 2 to 6 oxypropylene moieties in each molecule.

7. A process as claimed in claim 6, wherein the corrosion inhibitors are selected from mono-, di- or tri-ethanolamine, aromatic carboxylic acids, pyridine or pyrimidine derivatives and diethyl thiourea.

8. A process as claimed in claim 7, wherein the tin-plate surfaces contacted are those of food or beverage cans.

9. A process as claimed in claim 1, wherein said aqueous solution also contains:

200 to 800 ppm of one or more monobasic, dibasic or tribasic hydroxycarboxylic acids having from 4 to 7 carbon atoms in each molecule and a sum of hydroxyl and carboxyl groups in each molecule that is at least 3.

10. A process as claimed in claim 9, wherein the hydroxycarboxylic acid molecules are selected from monobasic or dibasic hydroxycarboxylic acid molecules each containing 6 carbon atoms and at least 4 hydroxyl groups.

11. A process as claimed claim 1, wherein said aqueous solution contains complex fluorides of both boron and zirconium in a ratio by weight of 4:1 to 1:1.

12. A process as claimed in claim 1, wherein the nonionic surfactants are selected from the group consisting of (i) alkanol ethoxylates having from 10 to 18 carbon atoms and from 4 to 12 oxyethylene moieties in each molecule and (ii) alkanol ethoxylate/propoxylates having from 10 to 18 carbon atoms, 3 to 7 oxyethylene moieties and 2 to 6 oxypropylene moieties in each molecule.

13. A process as claimed in claim 1, wherein the corrosion inhibitors are selected from mono-, di- or tri-ethanolamine, aromatic carboxylic acids, pyridine or pyrimidine derivatives and diethyl thiourea.

14. A water-based concentrate for preparing a cleaning solution by dilution with water, said concentrate comprising water and:

1.5 to 3% by weight of one or more substances selected from the group consisting of complex fluorides of boron, titanium, zirconium, hafnium, and mixtures of any two or more of boron, titanium, zirconium, and hafnium;

0.5 to 2% by weight of aluminum ions;

3 to 10% by weight of nonionic surfactants; and 1.5 to 5% by weight of corrosion inhibitor.

15. A water-based concentrate as claimed in claim 14, which additionally contains 1 to 10% by weight of a solubilizer.

16. A water-based concentrate as claimed in claim 14, which also contains:

2 to 8% by weight of one or more monobasic, dibasic or tribasic hydroxycarboxylic acids having from 4 to 7 carbon atoms in each molecule and a sum of hydroxyl and carboxyl groups in each molecule that is at least 3.

17. A water-based concentrate as claimed in claim 16, which additionally contains:

1 to 10% by weight of a solubilizer.

18. A water-based concentrate as claimed in claim 16, wherein the hydroxycarboxylic acid molecules are selected from monobasic or dibasic hydroxycarboxylic acid molecules each containing 6 carbon atoms and at least 4 hydroxyl groups.

19. A process according to claim 8 wherein contacting the cans is for 30 to 150 seconds at a temperature of 50 to 70° C. by spraying the cans with the cleaning solution or by dipping the cans in the cleaning solution.

20. An aqueous cleaning solution for tin-plated steel which has a pH value from 3 to 6 and contains water and:

150 to 300 ppm of complex fluorides selected from the group consisting of complex fluorides of boron, titanium, zirconium, hafnium, and mixtures of any two or more of boron, titanium, zirconium, and hafnium;

50 to 300 ppm of aluminum ions;

300 to 1,000 ppm of nonionic surfactants; and 50 to 500 ppm of corrosion inhibitor; and, optionally, one or more of hydroxycarboxylic acids and solubilizers.

* * * * *